US006545269B1

(12) United States Patent
Pierrejean et al.

(10) Patent No.: US 6,545,269 B1
(45) **Date of Patent: *Apr. 8, 2003**

(54) ION SOURCE FOR TIME-OF-FLIGHT MASS SPECTROMETERS FOR ANALYZING GAS SAMPLES

(75) Inventors: Didier Pierrejean, Villaz (FR); Bruno Galland, Chevannes (FR)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/550,171

(22) Filed: Apr. 14, 2000

(30) Foreign Application Priority Data

Apr. 22, 1999 (FR) ..... 99 05088

(51) Int. Cl.[7] ..... H01J 49/00
(52) U.S. Cl. ..... 250/288; 250/287; 250/423 R
(58) Field of Search ..... 250/423 R, 427, 250/288, 287

(56) References Cited

U.S. PATENT DOCUMENTS 3,819,941 A * 6/1974 Carrico ..... 250/281
3,852,595 A * 12/1974 Aberth ..... 250/423 F
5,852,295 A * 12/1998 Da Silveira et al. .... 250/423 R

FOREIGN PATENT DOCUMENTS

FR 2 294 539 A 7/1976
JP 11 040 069 A 2/1999

* cited by examiner

*Primary Examiner*—Kiet T. Nguyen
(74) *Attorney, Agent, or Firm*—Sughrue Mion, PLLC

(57) ABSTRACT

In accordance with the invention, the ion source of a time-of-flight mass spectrometer includes an electron gun having an electron source and at least one electrode for conditioning the flow of electrons, followed by at least one microchannel wafer for generating a pulsed secondary electron beam containing a greater number of electrons from a pulsed primary electron beam. The secondary electron beam enters a gas ionization area of an ion gun which produces a flow of ions which is then passed through the flight tube in order to be analyzed by an ion detector. This provides a high-performance ion source which is compact, sensitive and easy to integrate.

9 Claims, 2 Drawing Sheets

ION SOURCE FOR TIME-OF-FLIGHT MASS SPECTROMETERS FOR ANALYZING GAS SAMPLES

The present invention relates to means for ionizing gas samples for analysis in a mass spectrometer.

BACKGROUND OF THE INVENTION

A mass spectrometer analyses a gas sample by bombarding it with a flow of electrons, imparting movement to the ions obtained in this way and distinguishing them according to their trajectory or velocity.

To increase the measurement sensitivity and resolution of the mass spectrometer it is beneficial for the gas sample to be strongly ionized.

In time-of-flight mass spectrometers, ions produced by the ion source are launched into the entry of a flight tube, in which they retain a constant velocity. The nature of the ions is deduced from the time of flight corresponding to each type of ion in the gas sample to be analyzed, which is detected at the outlet from the flight tube. This entails launching a packet of previously accelerated ions into the entry of the flight tube and marking the departure time of the packet of ions and the arrival times of the various ions at the other end of the flight tube.

It is therefore advantageous to generate packets of ions with the shortest possible duration and containing a maximum number of ions. This is achieved with a pulse mode ion source.

The ion sources usually employed in mass spectrometers include an electron gun including a source of electrons and at least one electrode for conditioning the flow of electrons to generate an appropriate flow of electrons directed towards a gas ionization area in which ions are formed which are acted on by at least one electrode for conditioning the flow of ions. The flow of electrons is generally directed towards the gas ionization area in a direction perpendicular to the direction of the flight tube of the mass spectrometer. This results in a large overall size and makes integration difficult. A relatively small quantity of ions is produced, which limits the sensitivity of the apparatus.

OBJECTS AND SUMMARY OF THE INVENTION

The problem addressed by the present invention is that of designing a new ion source structure for mass spectrometers which is more compact and more sensitive and which can easily be integrated with other components of a mass spectrometer.

To achieve the above and other objects, an ion source in accordance with the invention, for use in mass spectrometers, includes an electron gun having an electron source and at least one electrode for conditioning the flow of electrons to generate an appropriate flow of electrons directed towards a gas ionization area in which ions are formed which are acted on by at least one electrode for conditioning the flow of ions; at least one microchannel wafer is disposed in the flow of electrons downstream of the electrodes for conditioning the flow of electrons so that a pulsed secondary electron beam containing many electrons is generated from a pulsed primary electron beam containing relatively few electrons.

The microchannel wafers multiply the flow of electrons to intensify subsequent ionization of the gas sample. This significantly increases the sensitivity and resolution of the apparatus.

An additional electrode for dispersing the secondary electron beam to retain its temporal properties and improve its spatial properties can advantageously be placed downstream of the area occupied by the microchannel wafer(s).

This encourages further intensification of the ionization of the gas sample and therefore increases the sensitivity of the apparatus incorporating the ion source.

The gas ionization area is preferably between an upstream repulsion electrode through which the secondary electron beam passes and which retains the electrons by repelling the ions and a downstream acceleration electrode which attracts the ions.

Because of this feature, the ion source can be at the entry of and aligned with the axis of the flight tube of a time-of-flight mass spectrometer. This achieves better integration of the ion source and makes the apparatus more compact.

For the secondary electron beam to retain its temporal properties and remain dense, so that all the ions of a packet of ions enter the flight tube at substantially the same time, the ionization area is preferably in the immediate vicinity of the microchannel wafer(s).

The electron source can be a filament heated to an appropriate temperature to generate a flow of electrons by thermal emission, in the conventional manner. The primary electron beam is then pulse modulated by a deflector electrode.

Alternatively, the electron source is advantageously a field-emission cathode with micropoints producing a pulse modulated primary electron beam.

The invention finds one particular application in the production of time-of-flight spectrometers incorporating an ion source of the above kind.

BRIEF DESCRIPTION OF THE DRAWINGS

Other objects, features and advantages of the present invention emerge from the following description of particular embodiments of the invention, which is given with reference to the accompanying drawings, in which.

MORE DETAILED DESCRIPTION

Figure 1:
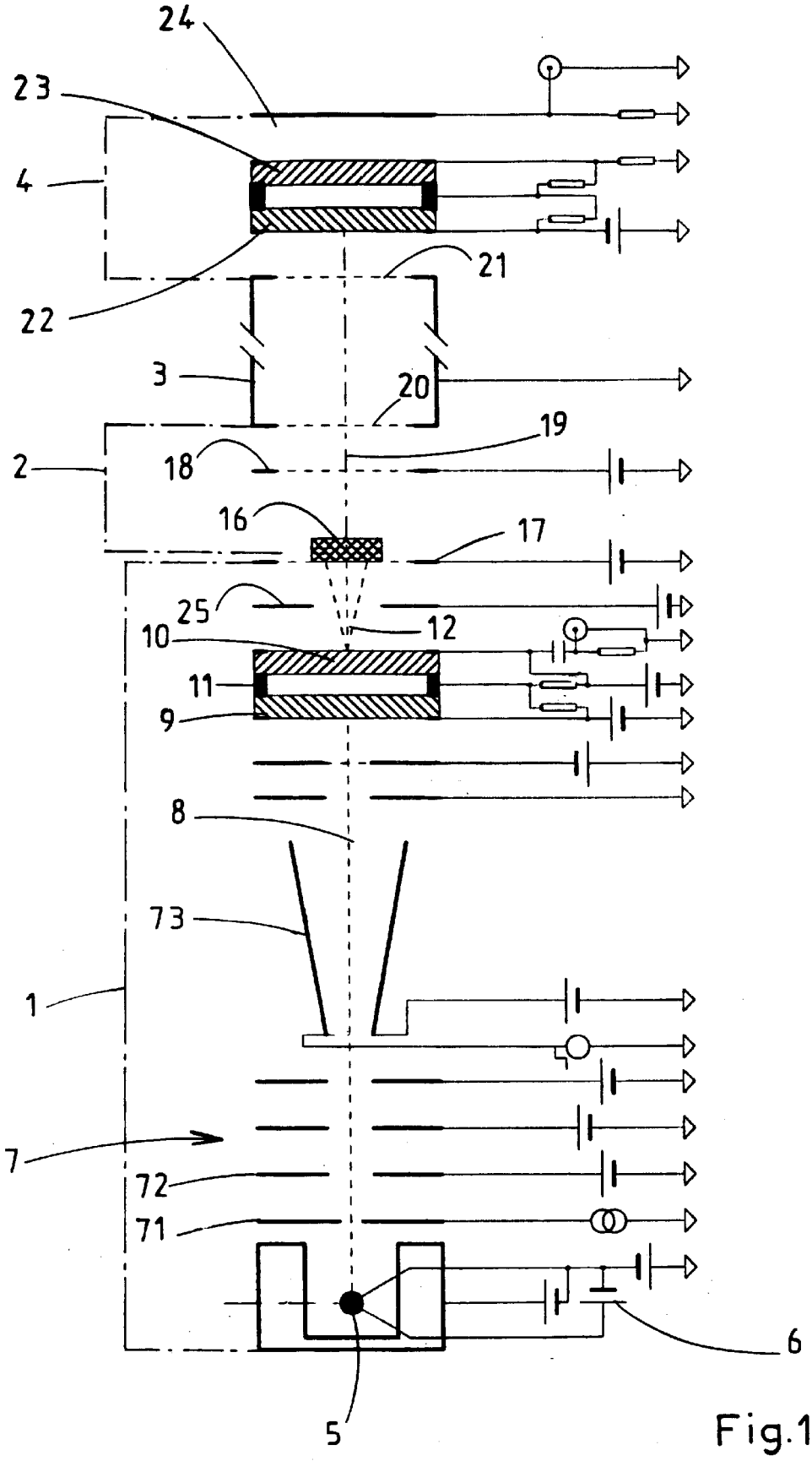
FIG. 1 is a diagram of a time-of-flight mass spectrometer.

Referring to FIG. 1, a time-of-flight mass spectrometer includes an electron gun 1 followed by an ion gun 2 in turn followed by a flight tube 3 whose outlet communicates with an ion detector 4.

The electron gun includes an electron source 5. The electron source 5 shown in the figure is a filament such as a tungsten filament powered by a heating generator 6 to heat it to a sufficiently high temperature for thermal emission of ions. The electrons emitted by the electron source 5 are acted on by at least one electrode 7 for conditioning the flow of electrons, for example an acceleration electrode 71 and at least one focusing electrode 72.

In the case of an electron source 5 in the form of a thermal emission filament, a deflector electrode 73 enables pulse mode modulation of the outgoing flow of electrons 8.

An alternative source of electrons 5 is a micropoint-type field-emission cathode including a conductive substrate on which are formed conductive micropoints housed in cavities of an insulative layer between the substrate and a positively biased grid. A micropoint-type field-emission cathode of the above kind can modulate the outflow of electrons itself, without requiring a deflector electrode 73.

The invention provides at least one microchannel wafer in the flow of electrons 8 downstream of the electrodes 7 for conditioning the flow of electrons. FIG. 1 shows a first microchannel wafer 9 and a second microchannel wafer 10 separated from each other by an interwafer electrode 11. The microchannel wafers 9 and 10 generate a pulsed secondary electron beam 12 containing many electrons from a pulsed primary electron beam 8 containing relatively few electrons, representing a gain from 100 to several thousand.

In practice, the primary electron beam can be equivalent to an electrical current in the order of 1 $\mu$A to 10 $\mu$A and the secondary electron beam can correspond to a current of several milliamperes, depending on the gain of the microchannel wafers 9 and 10.

The primary and secondary electron beams 8 and 12 can be made up of pulses whose duration is of the order of one nanosecond, for example.

Figure 2:
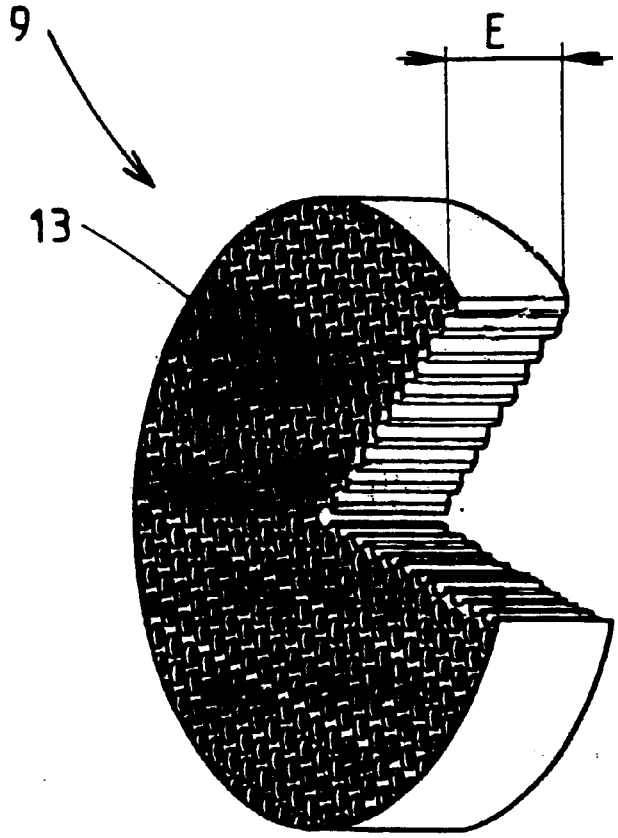
FIG. 2 is a partly cut away diagrammatic perspective view of a microchannel wafer for amplifying a flow of electrons.
Figure 3:
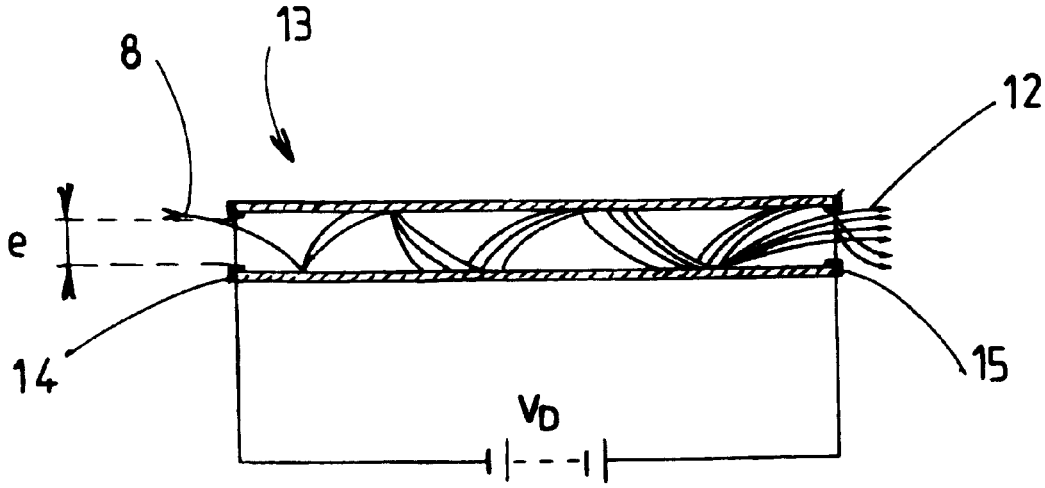
FIG. 3 is a view in longitudinal section of one channel of the microchannel wafer shown in FIG. 2, illustrating the principle of amplification of the flow of electrons.

The construction and theory of operation of the microchannel wafers are explained with reference to FIGS. 2 and 3. As shown in FIG. 2, a microchannel wafer 9 is a generally flat member having a thickness E of the order of 0.5 mm and consisting of the side-by-side juxtaposition of a very large number of glass capillary tubes, for example the tube 13, which have a very small diameter and are oriented along axes perpendicular to the general plane of the wafer 9. The capillary tubes can have a diameter e of approximately 12 microns and can open at opposite ends onto the main faces of the wafer 9. The main faces of the wafer 9 are metallized to constitute an input electrode 14 and an output electrode 15 to which a potential difference VD is applied (see FIG. 3). The potential at the output electrode 15 is higher than the potential at the input electrode 14. The inside wall of the capillary tube 13 is treated to have an appropriate resistance and forms an independent secondary electron multiplier. When an electron of the primary electron beam 8 enters the tube 13, it may impact on the wall of the tube 13 and detach at least one other electron, which is accelerated by the electric field between the input and output electrodes 14 and 15. The electrons detached in this way may themselves impact on the opposite wall of the tube 13, detaching other electrons which are themselves accelerated, and this progressively multiplies the number of electrons in motion, producing a secondary electron beam 12 containing many electrons.

Referring again to FIG. 1, the secondary electron beam 12 propagates as far as an ionization area 16 inside the ion gun 2. In the ionization area 16 the electrons impact on the atoms of the gas sample to be analyzed and convert them into ions. The gas ionization area 16 is between an upstream repulsion electrode 17 through which the secondary electron beam is passed and which retains the electrons by repelling the ions and a downstream acceleration electrode 18 which attracts the ions.

The flow of ions 19 obtained in this way is directed to the entry 20 of the flight tube 3 and then travels the length of the flight tube 3 to leave it via its outlet 21 and enter the ion detector 4. Thus, as shown in FIG. 1, the ion source is aligned with the entry of the flight tube 3 of the time-of-flight mass spectrometer.

The ion detector 4 can include microchannel wafers 22 and 23 generating an amplified flow of electrons impacting on a target electrode 24. Measurement is performed by detecting the electrical pulses collected by the target electrode 24.

FIG. 1 shows an additional electrode 25 downstream of the area occupied by the microchannel wafer(s) 9 and 10 of the electron gun for dispersing the secondary electron beam 12 so that it retains its temporal properties and to improve its spatial properties. This intensifies ionization in the ionization area 16.

The ionization area 16 is preferably in the immediate vicinity of the microchannel wafer 10, from which it is separated by a small distance, for example approximately 1 to 2 mm.

The present invention is not limited to the embodiments explicitly described, but encompasses variants and generalizations thereof that will be evident to the skilled person.

What is claimed is:

1. An ion source for mass spectrometers, the source including an electron gun having an electron source and at least one electron conditioning electrode which generates a flow of electrons directed towards a gas ionization area in which ions are formed which are acted on by at least one ion conditioning electrode, wherein at least one microchannel wafer is disposed in the flow of electrons downstream of said at least one electron conditioning electrode and generates a secondary electron beam, and wherein there is provided an additional electrode downstream of the area occupied by said at least one microchannel wafer for dispersing the secondary electron beam to retain temporal properties and improve spatial properties of the secondary electron beam.

2. An ion source according to claim 1, wherein the gas ionization area is between an upstream repulsion electrode through which the secondary electron beam is passed and which retains the electrons by repelling the ions and a downstream acceleration electrode which attracts the ions.

3. An ion source according to claim 1, the ion source being aligned with the entry of the flight tube of a time-of-flight mass spectrometer.

4. An ion source according to claim 1, wherein the gas ionization area is in the immediate vicinity of the microchannel wafer.

5. An ion source according to claim 1, wherein the electron source is a filament heated to an appropriate temperature to generate a flow of electrons by thermal emission and the primary electron beam is pulse modulated by a deflector electrode.

6. An ion source according to claim 1, wherein the electron source is a micropoint-type field-emission cathode producing a pulse modulated primary electron beam.

7. A time-of-flight mass spectrometer including an ion source according to claim 1.

8. An ion source for mass spectrometers, the source including an electron gun having an electron source and a electron conditioning means for conditioning a flow of electrons to generate a flow of electrons directed towards a gas ionization area in which ions are formed which are acted on by at least one ion conditioning means for conditioning the flow of ions, wherein at least one wafer means for conditioning the flow of electrons is disposed in the flow of electrons downstream of said first electron conditioning means and generates a secondary electron beam, and wherein there is provided means for dispersing the secondary electron beam to retain temporal properties and improving spatial properties of the secondary electron beam.

9. An ion source for mass spectrometers, the ion source including an electron gun having an electron source and at least one electron conditioning electrode which generates a flow of electrons directed towards a gas ionization area in which ions are formed which are acted on by at least one ion conditioning electrode, wherein at least one microchannel wafer is disposed in the flow of electrons downstream of said at least one electron conditioning electrode and generates a secondary electron beam wherein there is provided an additional electrode downstream of the area occupied by said at least one microchannel wafer for dispersing the secondary electron beam to retain temporal properties and improve spatial properties of the secondary electron beam, and wherein the ion source is aligned with an entry of a flight tube of a time-of-flight mass spectrometer.

* * * * *